US010691053B2

(12) United States Patent
Takada et al.

(10) Patent No.: US 10,691,053 B2
(45) Date of Patent: Jun. 23, 2020

(54) IMAGE FORMING APPARATUS

(71) Applicant: CANON KABUSHIKI KAISHA, Tokyo (JP)

(72) Inventors: Shigeaki Takada, Abiko (JP); Daigo Matsuura, Tokyo (JP); Masayuki Tamaki, Kashiwa (JP); Yasuharu Chiyoda, Nagareyama (JP); Masahiro Tsujibayashi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/505,081

(22) Filed: Jul. 8, 2019

(65) Prior Publication Data

US 2020/0033784 A1 Jan. 30, 2020

(30) Foreign Application Priority Data

Jul. 30, 2018 (JP) ..... 2018-142975

(51) Int. Cl.
*G03G 15/00* (2006.01)
*G03G 15/20* (2006.01)

(52) U.S. Cl.
CPC ..... *G03G 15/553* (2013.01); *G03G 15/2032* (2013.01); *G03G 15/2053* (2013.01)

(58) Field of Classification Search
CPC .. G03G 15/55; G03G 15/553; G03G 15/2032; G03G 15/2035
See application file for complete search history.

(56) References Cited

U.S. PATENT DOCUMENTS

| | | | | |
|---|---|---|---|---|
| 10,303,093 | B2 | 5/2019 | Tamaki et al. | |
| 2012/0093531 | A1* | 4/2012 | Yuasa | G03G 15/2032 399/67 |
| 2013/0279922 | A1* | 10/2013 | Ruiz | G03G 15/2035 399/21 |
| 2018/0246456 | A1* | 8/2018 | Uekawa | G03G 15/553 |
| 2018/0364631 | A1* | 12/2018 | Ogata | G03G 15/2064 |

FOREIGN PATENT DOCUMENTS

| | | | |
|---|---|---|---|
| JP | 2004-233848 | A | 8/2004 |
| JP | 2006-163017 | A | 6/2006 |
| JP | 2017-049295 | A | 3/2017 |

* cited by examiner

*Primary Examiner* — Carla J Therrien
(74) *Attorney, Agent, or Firm* — Venable LLP

(57) ABSTRACT

A pair of rotary members nips and conveys a recording material and a heating element heats a toner image on the recording material via the pair of rotary members. A separating mechanism separates the pair of rotary members. A heating time recording portion records a cumulative length of a period during which the pair of rotary members in an abutted state is heated as a first heating time and a cumulative length of the period during which the pair of rotary members in a separated state is heated as a second heating time. A determining portion determines a remaining lifetime of the pair of rotary members using the first and second heating times and data indicating a relationship between length of the period during which the pair of rotary members is heated and decrease in lifetime of the pair of rotary members.

13 Claims, 9 Drawing Sheets

IMAGE FORMING APPARATUS

BACKGROUND OF THE INVENTION

Field of the Invention

The present invention relates to an image forming apparatus for forming an image on a recording material.

Description of the Related Art

In an image forming apparatus of an electrophotographic system, a fixing unit, in which heat and pressure is applied to a toner image transferred to a recording material from a photosensitive member or an intermediate transfer body to fix the image on the recording material, is widely adopted. Such a fixing unit adopting a thermal fixing system includes a pair of rotary members that nip and convey the recording material and a heat source for heating the recording material. The pair of rotary members is deteriorated by being exposed to heat generated from the heat source, so the rotary members should be replaced at an appropriate timing.

Japanese Patent Laid-Open Publication No. 2017-049295 discloses an image forming apparatus capable of detecting temperature of a belt-like fixing film using a sensor and notifying to replace the fixing film based on a temperature zone in which the detected temperature belongs and a rotation amount, i.e., travel distance, of the fixing film. Further, as another method for determining lifetime of the pair of rotary members of the fixing unit, there is an attempt to predict remaining lifetime of the pair of rotary members based on cumulative energizing time of a resistor used as the heat source.

However, the cause that determines deterioration speed of the pair of rotary members in the fixing unit is not limited to thermal damage and abrasion that accompanies rotation.

SUMMARY OF THE INVENTION

The present invention provides an image forming apparatus of which predictability of replacement timing of a fixing unit can be improved.

According to one aspect of the invention, an image forming apparatus includes: an image forming unit configured to form a toner image on a recording material; a pair of rotary members configured to nip and convey the recording material on which the toner image has been formed by the image forming unit; a heating element configured to heat the toner image on the recording material via the pair of rotary members; a separating mechanism configured to separate the pair of rotary members; a heating time recording portion configured to record a first heating time and a second heating time, the first heating time being a cumulative length of a period during which the pair of rotary members in an abutted state is heated by the heating element, the second heating time being a cumulative length of the period during which the pair of rotary members in a separated state is heated by the heating element; a storage unit configured to store data indicating a relationship between length of the period during which the pair of rotary members is heated and decrease in lifetime of the pair of rotary members, the data being set such that a degree of decrease in lifetime of the pair of rotary members with respect to the first heating time is greater than a degree of decrease in lifetime of the pair of rotary members with respect to the second heating time; and a determining portion configured to determine a remaining lifetime of the pair of rotary members using the first heating time and the second heating time recorded by the heating time recording portion and the data stored in the storage unit.

According to another aspect of the invention, an image forming apparatus includes: an image forming unit configured to form a toner image on a recording material; a pair of rotary members configured to nip and convey the recording material on which the toner image has been formed by the image forming unit; a heating element configured to heat the toner image on the recording material via the pair of rotary members; a separating mechanism configured to separate the pair of rotary members; an executing portion configured to execute a notification process to notify information related to replacement of the pair of rotary members, wherein the executing portion executes the notification process such that as a ratio of a period during which the pair of rotary members is heated in a separated state by the heating element with respect to a total period during which the pair of rotary members is heated either in the separated state or in an abutted state by the heating element becomes greater, a cumulative length of a period during which the pair of rotary members is heated by the heating element since the pair of rotary members has been replaced until the notification process is executed becomes longer.

According to still another aspect of the invention, an image forming apparatus includes: an image forming unit configured to form a toner image on a recording material; a pair of rotary members configured to nip and convey the recording material on which the toner image has been formed by the image forming unit; a heating element configured to heat the toner image on the recording material via the pair of rotary members; a separating mechanism configured to separate the pair of rotary members; a rotation amount recording portion configured to record a first rotation amount and a second rotation amount, the first rotation amount being a cumulative rotation amount during which the pair of rotary members is rotated in an abutted state, the second rotation amount being a cumulative rotation amount during which the pair of rotary members is rotated in a separated state; a storage unit configured to store data indicating a relationship between rotation amount of the pair of rotary members and decrease in lifetime of the pair of rotary members, the data being set such that a degree of decrease in lifetime of the pair of rotary members with respect to the first rotation amount is greater than a degree of decrease in lifetime of the pair of rotary members with respect to the second rotation amount; and a determining portion configured to determine a remaining lifetime of the pair of rotary members using the first rotation amount and the second rotation amount recorded by the rotation amount recording portion and the data stored in the storage unit.

According to still another aspect of the invention, an image forming apparatus includes: an image forming unit configured to form a toner image on a recording material; a pair of rotary members configured to nip and convey the recording material on which the toner image has been formed by the image forming unit; a heating element configured to heat the toner image on the recording material via the pair of rotary members; a separating mechanism configured to separate the pair of rotary members; an executing portion configured to execute a notification process to notify information related to replacement of the pair of rotary members, wherein the executing portion executes the notification process such that as a ratio of a rotation amount during which the pair of rotary members is rotated in a separated state with respect to a total rotation amount during which the pair of rotary members is rotated either in an abutted state or in the separated state becomes greater, a cumulative value of the rotation amount during which the pair of rotary members is rotated since the pair of rotary members has been replaced until the notification process is executed becomes longer.

Further features of the present invention will become apparent from the following description of exemplary embodiments with reference to the attached drawings.

DESCRIPTION OF THE EMBODIMENTS

Now, exemplary embodiments of the present invention will be described with reference to the attached drawings.

First Embodiment

Figure 1:
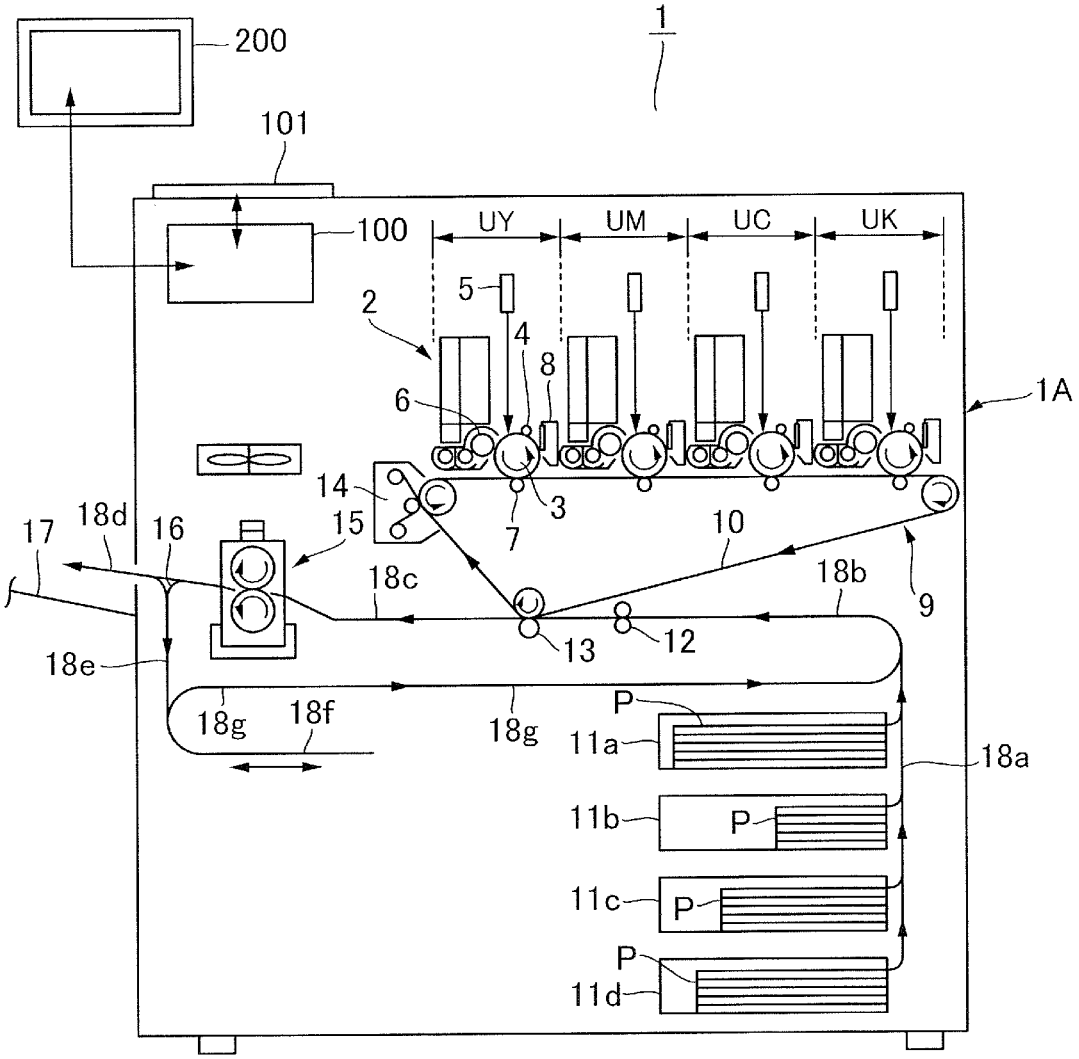
FIG. 1 is a schematic drawing of an image forming apparatus according to a first embodiment.

FIG. 1 is a schematic drawing illustrating a configuration of an image forming apparatus 1 according to a first embodiment. The image forming apparatus 1 is an electrophotographic color printer that forms an image on a recording material P based on image information entered to a control unit 100 from a host device 200 such as a personal computer (PC). Examples of the recording material P include paper such as normal paper and thick paper, plastic films such as overhead projector sheets, special sheets such as envelopes and index paper, and other sheet materials such as cloth.

An image forming unit 2 adopting a tandem-type intermediate transfer system including four imaging units UY, UM, UC and UK and an intermediate transfer unit 9 is installed in an apparatus body 1A of the image forming apparatus 1. The image forming unit 2 serves as the image forming unit of the present embodiment.

The imaging units UY through UK each includes a photosensitive drum 3, a charging unit 4, a laser scanner 5, a developing apparatus 6, a primary transfer apparatus 7 and a drum cleaner 8, and are configured to form toner images of respective colors of yellow, magenta, cyan and black by performing electrophotographic processes. That is, the charging unit 4 uniformly charges the surface of the photosensitive drum 3 serving as the photosensitive member, and by irradiating laser beams modulated according to image information from the laser scanner 5, an electrostatic latent image is written on the photosensitive drum 3. The developing apparatus 6 supplies charged toner to the photosensitive drum 3, by which the electrostatic latent image is developed as toner image.

The intermediate transfer unit 9 includes an intermediate transfer belt 10 serving as an intermediate transfer body, and a plurality of rollers across which the intermediate transfer belt 10 is stretched. The toner image borne on the photosensitive drum 3 of the respective imaging units UY through UK is primarily transferred to the intermediate transfer belt 10 by bias electric field formed by the primary transfer apparatus 7. In this state, the four-color toner images are transferred in a superposed manner, by which a full color toner image is formed on the belt. The toner image borne on the intermediate transfer belt 10 is conveyed to a secondary transfer portion serving as a nip portion between the intermediate transfer belt 10 and a secondary transfer roller 13 along with the rotation of the belt. Adhering materials such as toner remaining on the photosensitive drum 3 without being transferred to the intermediate transfer belt 10 is removed by a drum cleaner 8.

In parallel with the toner image forming process, the recording material P is fed from one of a plurality of cassettes 11*a*, 11*b*, 11*c* and 11*d*. The recording material P is passed through a sheet feed path 18*a* and a pre-transfer sheet conveyance path 18*b* to a registration roller 12. The registration roller 12 sends the recording material P to the secondary transfer portion at a matched timing with the progress of toner image forming process by the image forming unit 2. The toner image borne on the intermediate transfer belt 10 is secondarily transferred to the recording material P at the secondary transfer portion. Toner and other adhering materials remaining on the intermediate transfer belt 10 without being transferred to the recording material P is removed by a belt cleaner 14.

The recording material P that has passed through the secondary transfer portion and on which a non-fixed toner image is formed is conveyed through a pre-fixing sheet conveyance path 18*c* to a fixing unit 15. As described in detail later, the fixing unit 15 uses heat and pressure to fix the toner image to the recording material P. In the case of a single-side printing mode, the recording material P sent out from the fixing unit 15 is guided to a sheet discharge path 18*d* by a guide flap 16 and discharged onto a sheet discharge tray 17. In a duplex printing mode, the recording material P sent out from the fixing unit 15 is guided by the guide flap 16 to a reverse conveyance path 18*e*, reverse-conveyed in a switch-back path 18*f* and conveyed again through a re-conveyance path 18*g* toward the registration roller 12. Thereafter, the recording material P having image formed on a rear side thereof is conveyed through the sheet discharge path 18*d* and discharged onto the sheet discharge tray 17.

The above-described image forming unit 2 is one example of an image forming unit, and the configuration described hereafter can also be applied to an example where a direct transfer-type image forming unit in which toner image formed on a photosensitive member is directly transferred to the recording material.

Fixing Unit

Figure 2:
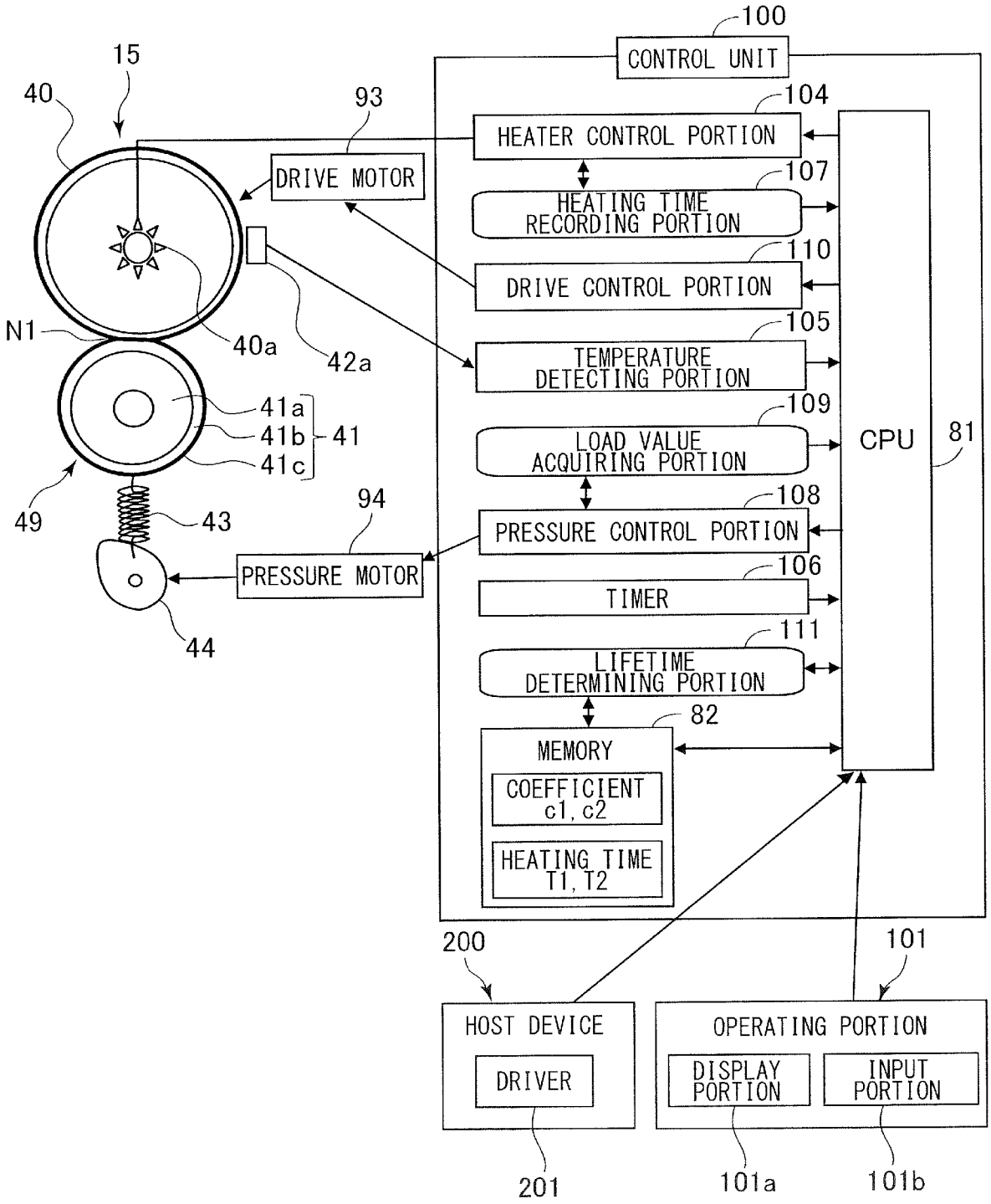
FIG. 2 is a view having combined a schematic drawing of a fixing unit according to the first embodiment with a block diagram illustrating a control structure of an image forming apparatus.

FIG. 2 is a view in which a schematic drawing of the fixing unit 15 is combined with a block diagram illustrating a control structure of the fixing unit 15. The fixing unit 15 according to the present embodiment adopts a heating roller system in which a roller pair (40, 41) nips and conveys the recording material P while heating the toner image. According further to the present embodiment, a so-called oil-less fixing unit is adopted by using toner containing a release agent.

The fixing unit 15 includes a fixing roller 40, a pressure roller 41 opposed to the fixing roller 40, and a heater 40*a* for heating the fixing roller 40. A fixing roller pair 49 composed of the fixing roller 40 and the pressure roller 41 serves as a pair of rotary members of the present embodiment that nips and conveys the recording material. The fixing roller 40 is a first rotary member abutted to a surface of the recording material P on which the toner image is transferred immediately before the material P is conveyed to the fixing unit 15, and the pressure roller 41 is a second rotary member that is abutted against an opposite side of the recording material P.

The heater 40*a* serving as a heating element of the present embodiment is a halogen heater arranged on an inner side of the fixing roller 40 having a cylindrical shape. The heater 40*a* can be replaced with a heating wire or an induction heating unit, as long as the recording material P can be heated via the fixing roller 40. It is also possible to arrange the heater 40*a* on an outer side of the fixing roller 40 to heat an outer circumference of the roller.

Figure 3:
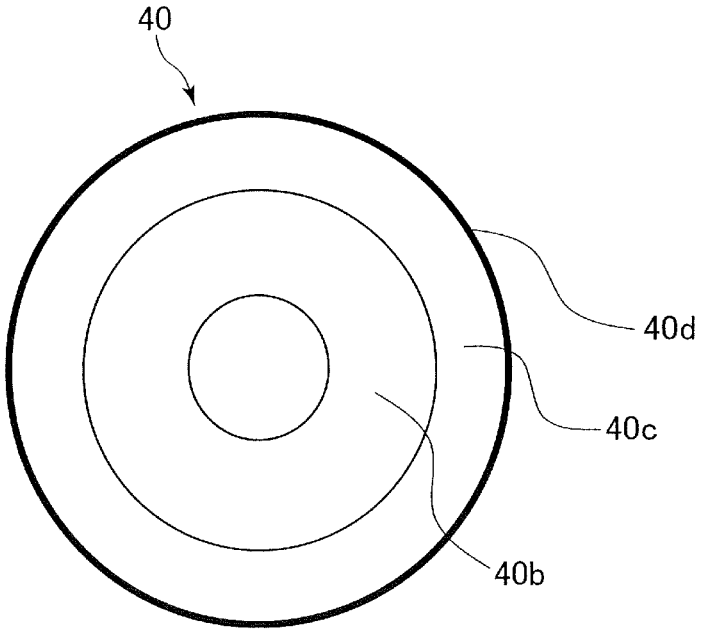
FIG. 3 is a schematic view of a fixing roller according to the first embodiment.

As illustrated in the schematic view of FIG. 3, the fixing roller 40 is constituted by an elastic layer 40*c* formed of a rubber material on a hollow core shaft, serving as a base layer, 40*b* formed of a metal material, and further by coating a release layer 40*d* serving as an uppermost layer thereon. The configuration example of the respective layers is as described below. The core shaft 40*b* is a cylindrical aluminum tube having an outer diameter of 68 mm, and on an inner side thereof is arranged the heater 40*a*. The elastic layer 40*c* is a silicon rubber having a JIS-A hardness (i.e., hardness measured with a Type A durometer) of 20 degrees formed to a thickness of 3.0 mm. The release layer 40*d* is formed of a resin material that has superior mold release property and that softens by rising of temperature, such as fluororesin, formed to a thickness of 50 μm. Suitable resin materials include PFA resin (polytetrafluoroethylene-perfluoroalkoxyethylene resin copolymer), PTFE (polytetrafluoroethylene) and so on. For example, the release layer 40*d* is formed by covering the elastic layer 40*c* with a PFA resin tube having a thickness of 30 to 100 μm. The release layer 40*d* can also be formed by coating the resin material on the surface of the elastic layer 40*c* by dipping, spraying and other possible methods.

The fixing roller 40 is supported so that both ends portions of the core shaft 40*b* in the longitudinal direction, i.e., rotational axis direction, are supported rotatably via a bearing member on a casing of the fixing unit 15. As illustrated in FIG. 2, the fixing roller 40 is driven to rotate by driving force of a drive motor 93. Rotational speed, i.e., peripheral speed, of the fixing roller 40 is set to 500 mm/sec, for example.

The pressure roller 41 is formed by disposing an elastic layer 41*b* formed of rubber material on a hollow core shaft, serving as a base layer, 41*a* formed of a metal material, and coating a release layer 41*c* serving as an uppermost layer thereon. The configuration examples of the respective layers are as described below. The core shaft 41*a* is a cylindrical aluminum tube having an outer diameter of 48 mm. The elastic layer 41*b* is a silicon rubber having a JIS-A hardness of 20 degrees formed to a thickness of 5.0 mm. The release layer 41*c* is formed of a resin material that has superior mold release property and that softens by increase of temperature, such as fluororesin, formed to a thickness of 50 μm. The same materials and methods for forming the release layer 40*d* of the fixing roller 40 can be adopted for the release layer 41*c*.

The pressure roller 41 is rotatably supported so that both ends portions of the core shaft 41*a* in the longitudinal direction, i.e., rotational axis direction, are supported via a bearing member on a casing of the fixing unit 15. The bearing member is movable in directions toward which the rotational axis of the pressure roller 41 approaches to and separates from the rotational axis of the fixing roller 40, i.e., upper and lower directions of FIG. 2, and the bearing is connected via a pressure spring 43 to a pressure cam 44. The pressure cam 44 is driven to rotate by a pressure motor 94, and switches whether or not to apply pressure to the pressure roller 41. In the present embodiment, the pressure roller 41 can be switched between a state being abutted with predetermined pressurizing force to the fixing roller 40 and a state being separated from the fixing roller 40, depending on rotation angles of the pressure cam 44. In a state where the pressure roller 41 is abutted against the fixing roller 40, the pressure roller 41 is driven to rotate by the fixing roller 40. The pressure cam 44 is an example of a separating mechanism for changing the pressurizing state of the pair of rotary members, and as long as the fixing roller 40 and the pressure roller 41 are relatively moved, it is possible to use a solenoid to move the pressure roller 41, for example.

The recording material being guided by a guide plate of the pre-fixing sheet conveyance path 18*c* (refer to FIG. 1) from the secondary transfer portion and having reached the fixing unit 15 enters the fixing unit through an opening formed on the casing of the fixing unit 15. Then, the recording material is guided by a pre-nip guide and enters a fixing nip N1 which is a nip portion of the fixing roller pair 49, where it is nipped and conveyed by the fixing roller 40 and the pressure roller 41. The toner image borne on the recording material is heated and pressed while passing through the fixing nip N1, by which toner particles are melted and mixed. After passing through the fixing nip N1, the toner image is cooled and fixed to the surface of the recording material, by which the image is fixed to the recording material. The recording material sent out from the fixing nip N1 is guided by a post-nip guide plate and discharged to an outer side of the casing of the fixing unit 15.

The control unit 100 illustrated in FIG. 2 bears control of the whole image forming apparatus, and includes a central processing unit (CPU) 81, a memory 82, and a plurality of function portions (104 to 111). The CPU 81 serving as an executing portion performs integrated control of the apparatus by reading and executing a program stored in the memory 82 and cooperating with respective function portions that exert specific functions. The memory 82 includes a volatile storage medium such as RAM and a nonvolatile storage medium such as ROM, and functions as a storage location of programs and data and also provides a workspace for the CPU 81 to execute programs.

The control unit 100 is connected to an operating portion 101 which is a user interface of the image forming apparatus, and also connected via a network to an external host device 200. The operating portion 101 includes a display portion 101*a* such as a liquid crystal panel that presents information to a user and the like, and an input portion 101*b* including a touch panel function of a liquid crystal panel and a physical button and through which a user and the like can enter instructions to the image forming apparatus. A driver software ("driver") 201 that corresponds to the image forming apparatus of the present embodiment is installed in the host device 200. Based on the operation of the user, the driver 201 receives data from a document editing application and the like and generates instruction signals for the image forming apparatus, and transmits the same through the network to the image forming apparatus. The CPU 81 of the control unit 100 starts a series of tasks for forming an image on a recording material, i.e., image forming job, based on an instruction to start image forming entered through the operating portion 101 or an instruction signal received from an exterior.

The user is capable of designating properties, such as size, grammage and material, of the recording material used for image forming through the operating portion 101 or the driver 201. When executing the image forming job, the control unit 100 determines a temperature setting of the fixing roller 40 based on property information of the recording material. A heater control portion 104 serving as a temperature control unit of the present embodiment controls the heater 40*a* so as to heat the fixing roller 40 until it reaches a target temperature corresponding to the temperature setting. In this state, a temperature detecting portion 105 detects surface temperature of the fixing roller 40 based on an output signal of a thermistor 42*a* serving as a temperature detection element, and the heater control portion 104 controls ON and OFF of power feed to the heater 40*a* by referring to the detection result of the temperature detecting portion 105. Thereby, the surface temperature of the fixing roller 40 in a state where the recording material passes through the fixing unit 15 is regulated at a predetermined temperature, such as approximately 150 degrees Celsius, suitable for fixing the toner image.

Based on the instruction from the CPU 81, a drive control portion 110 feeds power to the drive motor 93 and controls the rotation of the fixing roller 40. A pressure control portion 108 drives the pressure motor 94 based on a setting of pressurizing force determined by the CPU 81 based on the property information of the recording material and controls the rotation angle of the pressure cam 44. If a stepping motor is used as the pressure motor 94, the pressure control portion 108 designates the rotation amount of the stepping motor and directly controls the rotation angle of the pressure cam 44. A timer 106 has a function to communicate the current time to the CPU 81 or other function portions. Other function portions (107, 109 and 111) related to determining lifetime of the fixing roller pair 49 will be described later.

The fixing roller 40 of the present embodiment uses silicone rubber as the elastic layer 40*c*. Generally, rubber including silicone rubber is cured through crosslinking reaction of main chains. However, in a case where the release layer 40*d* is formed on the elastic layer 40*c*, if heated in a sealed state, the main chain of the rubber is cut, and as the heating time increases, softening degradation of the elastic layer 40*c* occurs. This is considered to be caused by the elastic layer 40*c* being in a sealed state, i.e., deoxygenated state, by the release layer 40*d*.

Figure 4:
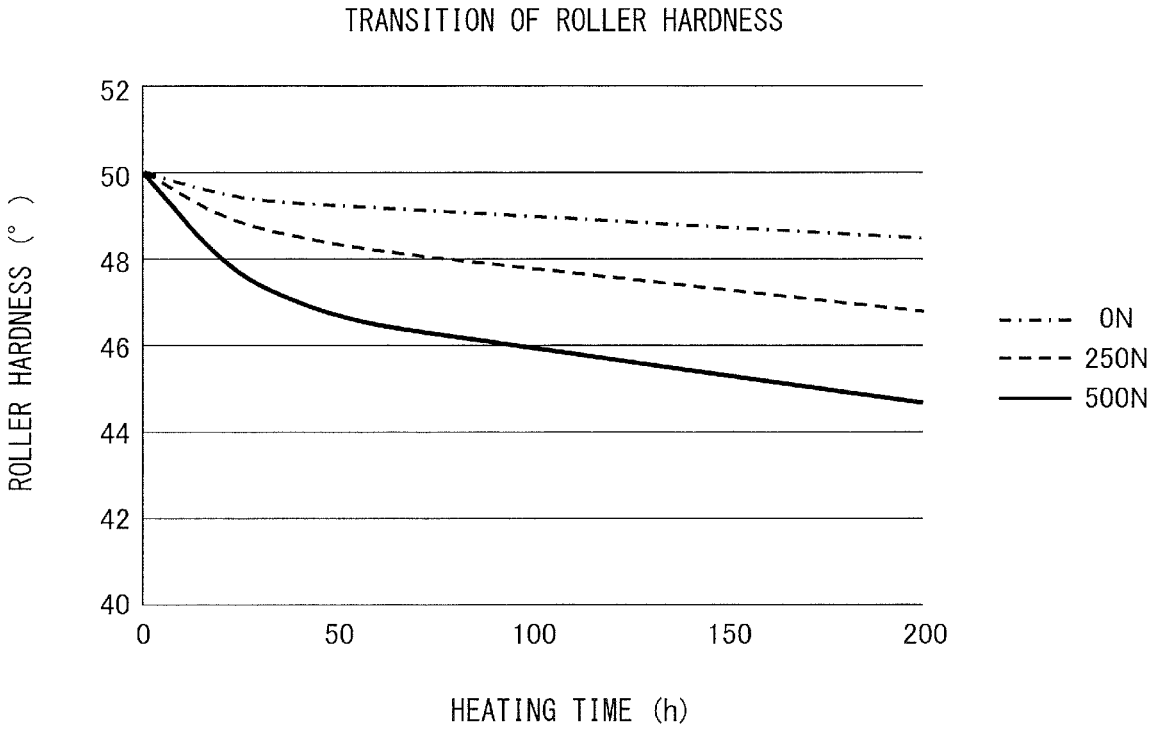
FIG. 4 is a graph illustrating transition of hardness with respect to heating time of a fixing roller according to the first embodiment.

Further, in order to confirm the influence of pressurizing force regarding softening degradation of the fixing roller 40, change of hardness with respect to heating time has been examined by changing the pressurizing force of the fixing roller pair 49. FIG. 4 illustrates the test results thereof. Solid line corresponds to a case where the fixing roller pair 49 is abutted with relatively strong pressurizing force (500 N), dashed line corresponds to a case where the fixing roller pair 49 is abutted with relatively weak pressurizing force (250 N), and dot and dash line corresponds to a case where the fixing roller pair is separated (pressurizing force: 0 N). Pressurizing state of the fixing roller pair 49 was set to one of the states described above, the fixing roller pair 49 was rotated while heating the fixing roller 40, and the fixing roller pair 49 was stopped each time a predetermined time has elapsed to measure the hardness. In the measurement, an Asker-C rubber hardness meter (product of Kobunshi Keiki Co., Ltd.) was used to measure the rubber hardness at 12 voluntary points on the roller surface, and an average value thereof was adopted as the hardness of the fixing roller 40 at the point of time of measurement.

As can be seen clearly from the graph, the hardness tended to decrease as the heating time of the fixing roller 40 increased. Reduction width of hardness was greater in the case where the fixing roller pair 49 was abutted with a pressurizing force of 250 N than in the case where the fixing roller pair 49 was separated, and was further greater in the case where the fixing roller pair 49 was abutted with a pressurizing force of 500 N than in the case where the fixing roller pair 49 was abutted with a pressurizing force of 250 N. This is considered to be caused by mechanical stress accompanying pressurization accelerating the cutting of the rubber main chain by heat. In a case where softening degradation of the elastic layer 40*c* progresses, the risk of occurrence of damage to the fixing roller 40 due to the fracture of the elastic layer 40*c* is increased.

The fixing roller 40 is not limited to being heated constantly in the pressurized state, and there may be a case where the fixing roller pair 49 is heated in the separated state. For example, during a standby period after completion of an image forming job and before input of a successive image forming job, the fixing roller 40 may be pre-heated while the fixing roller pair 49 is separated. In the case of an image forming apparatus having a power saving mode, whether to preheat the fixing roller 40 or not (or the length of time to continue preheating) in standby state may be set to be switched based on whether the mode is set to power saving mode or normal mode. By this reason, even when the cumulative heating time is the same, the degradation level of the elastic layer 40*c* is not necessary fixed depending on the state of use of the image forming apparatus.

Lifetime Determination

Therefore, in the present embodiment, heating time is respectively measured separately for the case where the fixing roller pair 49 is in the abutted state and for the case where the fixing roller pair 49 is in the separated state. Then, the degradation level of the fixing roller 40 is estimated using a coefficient representing the relationship between respective heating time and rate of progression of deterioration of the fixing roller 40, and the remaining lifetime of the fixing roller 40 is determined.

TABLE 1

| PRESSURIZING FORCE[N] | HEATING TIME[min] | COEFFICIENT |
|---|---|---|
| 500 | T1 | c1 |
| 0 | T2 | c2 |

As illustrated in Table 1, in the present embodiment, the pressurizing state of the fixing roller pair 49 is divided into two divisions, which are a state where the pressurizing force is 500 N, that is, a state where the pair of rollers is abutted against each other, and a state where the pressurizing force is 0 N, that is, a state where the pair of rollers is separated. If the coefficient of each division of the pressurizing state is referred to as ci (i=1, 2) and the length of heating timer of each division of the pressurizing state is referred to as T1 and T2 [min], in the present embodiment, LIFE value (%) which is a variable for managing the lifetime of the fixing roller 40 is represented by the following expression.

$$\text{LIFE} = \left[\sum_{i=1}^{2} \frac{Ti \times ci}{A}\right] \times 100 \quad (1)$$

The value of coefficient ci that carries out weighting according to the pressurizing state was determined in advance based on the length of the heating time until the hardness of the fixing roller 40 is deteriorated for a predetermined amount by a testing method using FIG. 4. The value of coefficient cl in a state where the fixing roller pair 49 is abutted against each other is greater than the value of coefficient c2 in a state where the fixing roller pair 49 is separated.

Specifically, for example, the heating time for the hardness of the fixing roller to deteriorate for 3 degrees from an initial value is assumed as follows.

Pressurizing force 500 N:Ta [min]

Pressurizing force 0 N:Tb [min]

Here, the ratio of coefficients c1 and c2 is set equal to an inverse number of ratio of heating times Ta and Tb. For example, if Ta is 2400 [min] and Tb is 10800 [min], the ratio of heating time (Ta:Tb) is (1:4.5). Therefore, if the ratio of coefficients (c1:c2) is set to be (4.5:1), for example, c1=4.5 and c2=1, coefficients c1 and c2 that realize weighting to compensate for the difference of deterioration speed of hardness caused by application or non-application of pressure can be acquired.

Further, constant "A" of Expression (1) is a normalization constant determined by the relationship between coefficients c1 and c2, and it is set in advance so that the timing at which LIFE value becomes 100% corresponds to an end point of lifetime of the fixing roller 40, that is, end of service life based on design at which time replacement is required. For example, if the state in which the hardness of the fixing roller 40 is deteriorated for 3 degrees from the initial value is set as end of service life of the fixing roller pair 49, the value of coefficient c1 is set to 4.5 and the value of constant "A" is set to 10800. In this case, if the fixing roller 40 is heated while the fixing roller pair 49 is in an abutted state with pressurizing force of 500 N, the point of time at which the heating time has reached 2400 [min] is the end point of lifetime of the fixing roller 40.

Next, the control structure related to determining lifetime of the fixing roller pair 49 will be described. The load value acquiring portion 109 illustrated in FIG. 2 acquires the present pressurizing state of the fixing roller pair 49 by referring to the pressure control portion 108. In the case of the present embodiment, the load value acquiring portion 109 acquires information indicating whether the fixing roller pair 49 is abutted or separated. The pressurizing state is acquired in real time, such as every 0.1 seconds, at least during a period in which power is fed to the heater 40*a*. The load value acquiring portion 109 serves as a pressurizing state acquiring portion that acquires the pressurizing state of the pair of rotary members of the fixing unit.

A heating time recording portion 107 records the heating time, which is a cumulative length of the period during which the fixing roller 40 is heated, to the memory 82. That is, the heating time recording portion 107 successively updates heating time T1 or T2 corresponding to the current pressurizing state of the fixing roller pair 49 acquired by the load value acquiring portion 109 during the period in which the heater control portion 104 energizes the heater 40*a*. A storage area for storing the heating times T1 and T2 per each division of the pressurizing state is prepared in the memory 82, and values of heating times T1 and T2 updated by the heating time recording portion 107 are stored. The heating time recording portion 107 serves as a heating time recording portion of the present embodiment that records respective lengths of the period in which the pair of rotary members is heated per pressurizing state of the pair of rotary members. The heating time T1 serves as a first heating time of the present embodiment, which is a cumulative length of the period during which the pair of rotary members is heated by the heating element in a state where the pair of rotary members is abutted. The heating time T2 serves as a second heating time of the present embodiment, which is a cumulative length of the period during which the pair of rotary members is heated by the heating element in a state where the pair of rotary members is separated. The memory 82 is a storage unit of the present embodiment storing coefficients c1 and c2 and heating times T1 and T2. The coefficients c1 and c2 are examples of data representing the relationship between length of the period in which the pair of rotary members is heated and decrease in lifetime of the pair of rotary members. The coefficient c1 serves as a first coefficient of the present embodiment representing a rate of decrease in lifetime of the pair of rotary members per unit length of the first heating time (T1), and the coefficient c2 serves as a second coefficient of the present embodiment representing a rate of decrease in lifetime of the pair of rotary members per unit length of the second heating time (T2).

A lifetime determining portion 111 calculates LIFE value using coefficients c1 and c2 and heating times T1 and T2, and performs lifetime determination of the fixing unit 15. The lifetime determining portion is a determining portion of the present embodiment that determines the remaining lifetime of the pair of rotary members of the fixing unit. The respective function portions (104 to 111) of the control unit 100 can be implemented as software as a function unit of programs executed by the CPU 81 or other processing devices, or they can be implemented as independent hardware such as ASIC on the circuit of the control unit 100. Further, the lifetime determining portion 111 may be configured to refer to a table of equal value to the expression (1) stored in advance in the memory 82 without calculating the expression (1) to thereby acquire the LIFE value corresponding to heating times T1 and T2 of the point of time when lifetime determination is performed.

Figure 5:
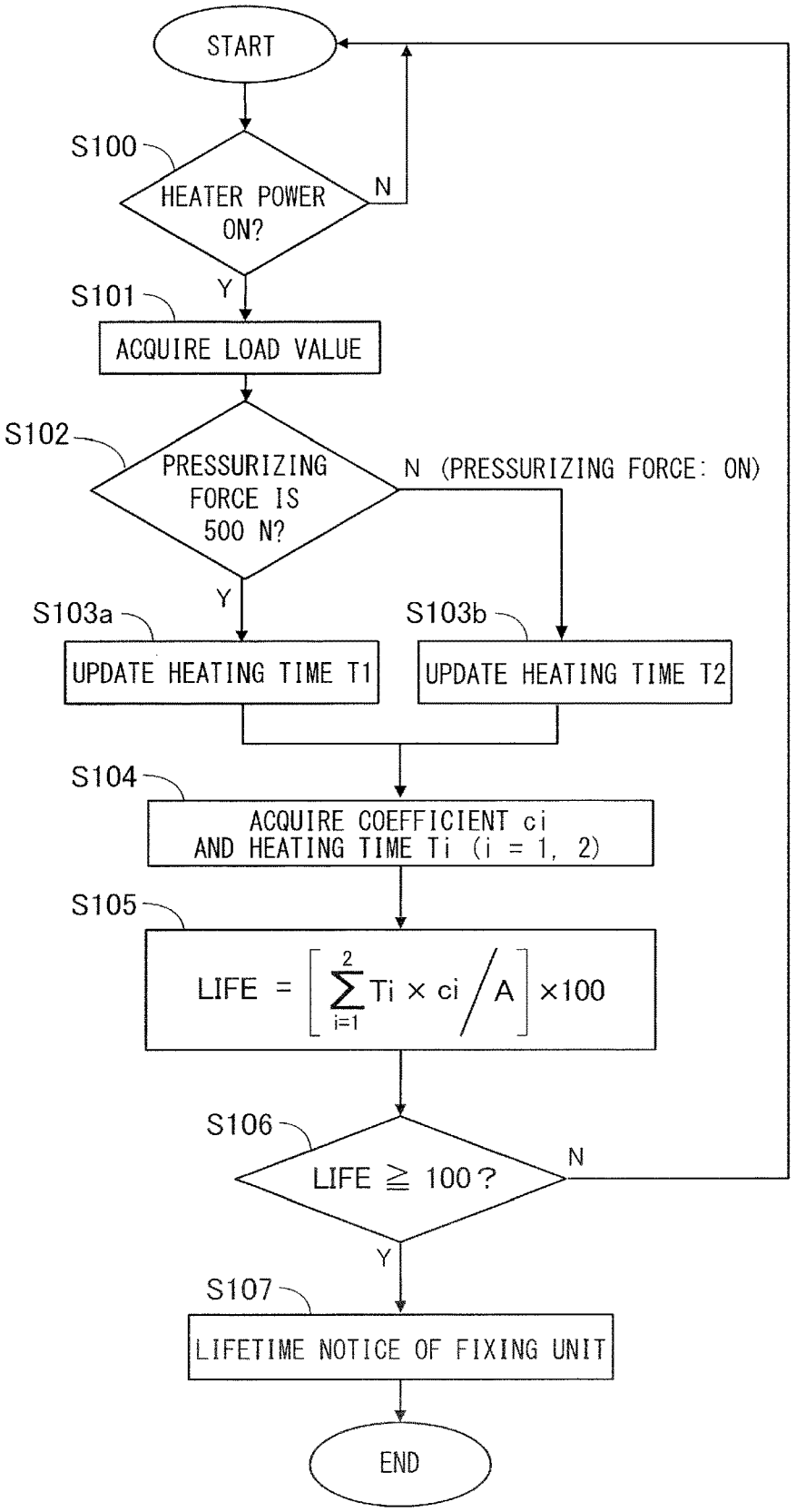
FIG. 5 is a flowchart illustrating a lifetime determination method of the fixing unit according to the first embodiment.

Now, a flow of control related to determination of lifetime of the fixing roller pair 49 will be described with reference to the flowchart of FIG. 5. The following processes will be executed continuously during the period in which the main power of the image forming apparatus is turned on.

At first, the CPU 81 determines whether the heater 40*a* is energized (S100). If the heater 40*a* is energized, the load value acquiring portion 109 acquires the current setting of pressurizing force, and the result is notified to the CPU 81 (S101). The CPU 81 branches the processing based on the value of the pressurizing force being notified (S102). In a state where the pressurizing force is 500 N, that is, if the fixing roller pair 49 is abutted, the heating time recording portion 107 updates the value of heating time T1 corresponding to pressurizing force 500 N (S103*a*). In a state where the pressurizing force is 0 N, the heating time recording portion 107 updates the value of the heating time T2 corresponding to the pressurizing force 0 N (S103*b*).

The lifetime determining portion 111 acquires the coefficients c1 and c2 stored in advance in the memory 82 and the heating times T1 and T2 having been recorded by the heating time recording portion 107 (S104), and calculates LIFE value according to expression (1) (S105). If the calculated LIFE value is less than 100%, the lifetime determining portion 111 decides that there is no need to replace the fixing unit 15, and the procedure returns to S100. If LIFE value is 100% or greater, the CPU 81 performs lifetime notice of the fixing unit 15 (S107). In the present embodiment, the CPU 81 functions as a notification unit that performs notification process (S107) based on the detection result of S106.

Lifetime notice of the fixing unit 15 refers to notifying the user or the like the information indicating that the period of durability of the fixing unit 15 is near and that there is a need for replacement. Specifically, a message notifying that the fixing unit should be replaced is displayed on the display portion 101*a* of the operating portion 101, or a signal for displaying a message notifying that the fixing unit should be replaced on a display of the host device 200 is transmitted to the host device 200 via the network. According to another example, a message stating that a fixing unit for replacement must be prepared is notified to an operation center that is in charge of maintenance of the image forming apparatus.

Advantages of the Present Embodiment

According to a conventional configuration where determination of lifetime of the fixing unit 15 is performed based on the length of heating time without considering whether the fixing roller pair 49 is abutted or not, the level of mechanical stress that the fixing roller 40 receives causes the actual degradation level of the elastic layer 40*c* to be dispersed when lifetime notice is notified. In that case, if the lifetime of the fixing unit 15 is set long, degradation may advance and exceed the permissible range of softening degradation of the fixing roller 40 before the fixing unit 15 is replaced, which may cause problems such as conveyance failure including wrinkling of the sheet or curling of the rear end of the sheet, or fracture of the elastic layer 40*c*. In order to avoid such problems from occurring, usually, the lifetime of the fixing unit 15 is determined to correspond to the case where the fixing unit is used under a most severe condition. However, there was a possibility of replacing the fixing unit 15 even though the softening degradation of the fixing roller 40 is not advanced so much, in which case downtime caused by replacement and increase of maintenance costs of the image forming apparatus occurred.

According to the present embodiment, the degradation level of the fixing roller 40 during the period in which the fixing roller pair 49 was abutted and the degradation level of the fixing roller 40 during the period in which the fixing roller pair 49 was separated are estimated independently, and based on the total (i.e., LIFE value) of the two values, lifetime determination of the fixing unit 15 is performed. Accordingly, the LIFE value more appropriately reflects the actual degradation level of the fixing roller 40, and predictability of replacement timing of the fixing unit 15 is increased. For example, if there was a user whose LIFE value was increased by 10% every month, if the current LIFE value is 80%, it may be possible to schedule replacement of the fixing unit in approximately two months, and service operation plans can be set easily. Further, it is possible to display on the display portion 101*a* that the remaining lifetime of the fixing unit 15 is 20% when the current LIFE value is 80%, according to which the user can recognize a rough estimate of the replacement timing.

Further, the present embodiment is configured to delay the lifetime notice (S107) of the fixing unit 15 as the period during which the fixing roller pair 49 is separated (T2) occupies a greater ratio in the total period (T1+T2) during which the fixing roller 40 was heated. That is, as the ratio in which the period during which the fixing roller pair 49 was separated occupies a greater ratio in the total heating time, the cumulative time of the period during which the fixing roller 40 was heated before the notification process is executed becomes long. As a result, lifetime notice will be output at a timing where deterioration of the fixing roller 40 is advanced and the actual need for replacement has increased. In other words, according to the present embodiment, lifetime of the fixing roller 40 can be set long while avoiding conveyance failure and fracture of the elastic layer 40*c*.

Modified Example

In the present embodiment, a case has been described where the pair of rotary members nipping the recording material in the fixing unit 15 is a pair of rollers, but the present invention is also applicable to a case where one of or both the pair of rotary members is a belt member. Further, it is also possible to execute the process in a state where the LIFE value has reached a threshold value (such as 80%) that is less than 100%, instead of at a timing where the LIFE value has reached 100% as according to the present embodiment.

Second Embodiment

Next, an image forming apparatus according to a second embodiment will be described. The present embodiment differs from the first embodiment in that in a case where the fixing roller pairs is mutually abutted, the state can be changed to a plurality of states with different pressurizing forces. The other configurations and function elements similar to the first embodiment are denoted with the same reference numbers as the first embodiment and descriptions thereof are omitted.

The pressure control portion 108 (refer to FIG. 2) according to the present embodiment is capable of abutting or separating the fixing roller pair 49 and further capable of changing the pressurizing force of the fixing roller pair 49 in the abutted state between two levels, which are 250 N and 500 N. If the pressuring force is changed in this manner, contact area of the fixing roller pair 49 at the fixing nip N1 is varied, and heat quantity provided to the recording material passing through the fixing nip N1 can be adjusted, so that the device can cope with various types of recording materials.

As illustrated in the following Table 2, the present embodiment divides the pressurizing states of the fixing roller pair 49 into three divisions, which are pressurizing forces 500 N, 250 N and 0 N. Heating time Ti [min] (i=1, 2, 3) and coefficient ci of the fixing roller 40 are monitored for each division of the pressurizing state.

TABLE 2

| PRESSURIZING FORCE[N] | HEATING TIME[min] | COEFFICIENT |
|---|---|---|
| 500 | T1 | c1 |
| 250 | T2 | c2 |
| 0 | T3 | c3 |

An expression for calculating LIFE value according to the present embodiment is as follows. In the expression, constant "A" refers to a normalization constant which is determined in advance with coefficients c1, c2 and c3. Further, magnitude correlation of c1, c2 and c3 is as follows: c1>c2>c3.

$$\text{LIFE} = \left[\sum_{i=1}^{3} \frac{Ti \times ci}{A}\right] \times 100 \tag{2}$$

The control unit 100 according to the present embodiment performs lifetime determination of the fixing unit 15 by a similar processing as the first embodiment, except for updating one of heating times T1 through T3 corresponding to the current pressurizing state and calculating the LIFE value using coefficients c1 to c3 and heating times T1 to T3. That is, during energization of the heater 40*a*, the heating time recording portion 107 updates one of the heating times T1, T2 and T3 corresponding to the pressurizing force that is acquired by the load value acquiring portion 109. The heating time T1 serves as a first heating time which is the cumulative length of the period during which the pair of rotary members is heated by the heating element in a state where the pair of rotary members is abutted by a first pressurizing force (which is 500 N in this example). In contrast, the heating time T3 serves as a third heating time which is the cumulative length of the period during which the pair of rotary members is heated by the heating element in a state where the pair of rotary members is abutted with a second pressurizing force which is smaller than the first pressurizing force. Further, coefficient c3 serves as a third coefficient of the present embodiment representing a rate of decrease in the remaining lifetime of the pair of rotary members per unit length of the third heating time. The lifetime determining portion 111 calculates a LIFE value according to Expression (2) using coefficients c1 to c3 stored in advance in the memory 82 and the heating times T1 to T3 recorded by the heating time recording portion 107 (refer to S104 and S105 of FIG. 5). Then, if the LIFE value is 100% or greater, lifetime notice of the fixing unit 15 is executed as the notification process (S106, S107).

According to this configuration, similar to the first embodiment, lifetime notice is performed at an appropriate timing regardless of the state of use of the image forming apparatus, and the predictability of the replacement timing of the fixing unit 15 is improved. Especially according to the present embodiment, the fixing roller pair 49 can be changed to a plurality of states with different pressurizing forces so that heating time Ti is recorded for each pressurizing state and coefficient ci is set to different values for each pressurizing state. As described with reference to FIG. 4, speed of advancement of softening degradation of the fixing roller 40 varies not only based on whether pressure is applied on the fixing roller pair 49 but also according to the size of pressurizing force. According to the present embodiment, the change caused by the size difference of pressurizing force is reflected on the LIFE value, by which the predictability of replacement timing of the fixing unit 15 can be improved even further.

Third Embodiment

Next, an image forming apparatus according to a third embodiment will be described. The present embodiment differs from the second embodiment in that a plurality of temperature settings having different target temperatures of the fixing roller 40 are used in arranging the fixing roller pairs in abutted state. The other configurations and operation elements similar to the first and second embodiments are denoted with the same reference numbers as the first and second embodiments, and descriptions thereof are omitted.

In the present embodiment, the pressurizing state of the fixing roller pair 49 can be changed in three steps to pressurizing forces 500 N, 250 N and 0 N. Further, temperature setting in a state where the fixing roller pair 49 is in abutted states (500 N, 250 N) can be selected among temperature settings 1 to 3, in which the target temperature of fixing roller 50 is either 150, 170 or 190 degrees Celsius. For example, in the case where the recording material used for image forming is a thin paper having small grammage, temperature setting 1 having a low target temperature is selected, whereas in the case of a thick paper or the like having a large grammage, temperature setting 3 having a high target temperature is selected. Combination of pressurizing force and temperature setting is determined based on the property of the recording material according to criteria determined in advance considering heat capacity, strength and the like of the recording material.

The deterioration rate of the fixing roller 40 varies according to interaction of heat stress caused by heating of the heater 40*a* and mechanical stress of abutment with the pressure roller 41. That is, even if the pressurizing force of the fixing roller pair 49 is fixed, the deterioration rate of the fixing roller 40 varies by temperature setting of the fixing roller 40. Therefore, as illustrated in the following Table 3, according to the present embodiment, heating time Ti [min] (i=1 to 7) and coefficient ci of the fixing roller pair 49 are managed per division of the pressurizing state and per temperature setting.

TABLE 3

| | | COEFFICIENT | | |
|---|---|---|---|---|
| PRESSURIZING FORCE[N] | HEATING TIME[min] | TEMPEARTURE SETTING 1 (150° C.) | TEMPERATURE SETTING 2 (170° C.) | TEMPERATURE SETTING 3 (190° C.) |
| 500 | T1 | c1 | — | — |
| | T2 | — | c2 | — |
| | T3 | — | — | c3 |
| 250 | T4 | c4 | — | — |
| | T5 | — | c5 | — |
| | T6 | — | — | c6 |
| 0 | T7 | c7 | — | — |

Expression for calculating LIFE value according to the present embodiment is as follows. Constant "A" is a normalization constant set in advance together with coefficients c1 to c7. If the temperature setting is the same, coefficients c1 to c7 are set to greater values as the pressurizing force increases (c1>c4>c7, c2>c5, c3>c6). If the pressurizing force is the same, coefficients c1 to c7 are set to greater values as the target temperature rises (c1<c2<c3, c4<c5<c6).

$$\text{LIFE} = \left[\sum_{i=1}^{7} \frac{Ti \times ci}{A}\right] \times 100 \tag{3}$$

The control unit 100 according to the present embodiment performs lifetime determination of the fixing unit 15 by a similar processing as the first embodiment, except for updating one of heating times T1 to T7 according to the current pressurizing state and current temperature setting and calculating the LIFE value using coefficients c1 to c7 and heating times T1 to T7. That is, during energization of the heater 40*a*, the heating time recording portion 107 updates one of heating times T1 to T7 based on the pressurizing force acquired by the load value acquiring portion 109 and the target temperature of the heater control portion 104. The lifetime determining portion 111 calculates the LIFE value according to Expression (3) using coefficients c1 to c7 stored in advance in the memory 82 and the heating times T1 to T7 recorded by the heating time recording portion 107 (refer to S104 and S105 of FIG. 5). Then, in a case where the LIFE value is 100% or greater, lifetime notice of the fixing unit 15 is executed as a notification process (S106, S107).

According to this configuration, similar to the first embodiment, lifetime notice is performed at an appropriate timing regardless of the state of use of the image forming apparatus, so that the predictability of replacement timing of the fixing unit 15 can be improved. Especially according to the present embodiment, coefficient ci is set to different values according to the pressurizing states and the temperature settings of the fixing roller pair 49, and the heating time Ti is respectively recorded. According to the present embodiment, not only the level of pressurizing force but also the degree of heat stress applied on the fixing roller 40 is reflected on the LIFE value, so that the predictability of replacement timing of the fixing unit 15 can be improved even further.

Fourth Embodiment

Next, an image forming apparatus according to a fourth embodiment will be described. In the present embodiment, one of a pair of rotary members that nip and convey the recording material is formed of a belt member. In the following description, elements having the same configurations and effects as the first embodiment are denoted with the same reference numbers as the first embodiment, and descriptions thereof are omitted.

Figure 6:
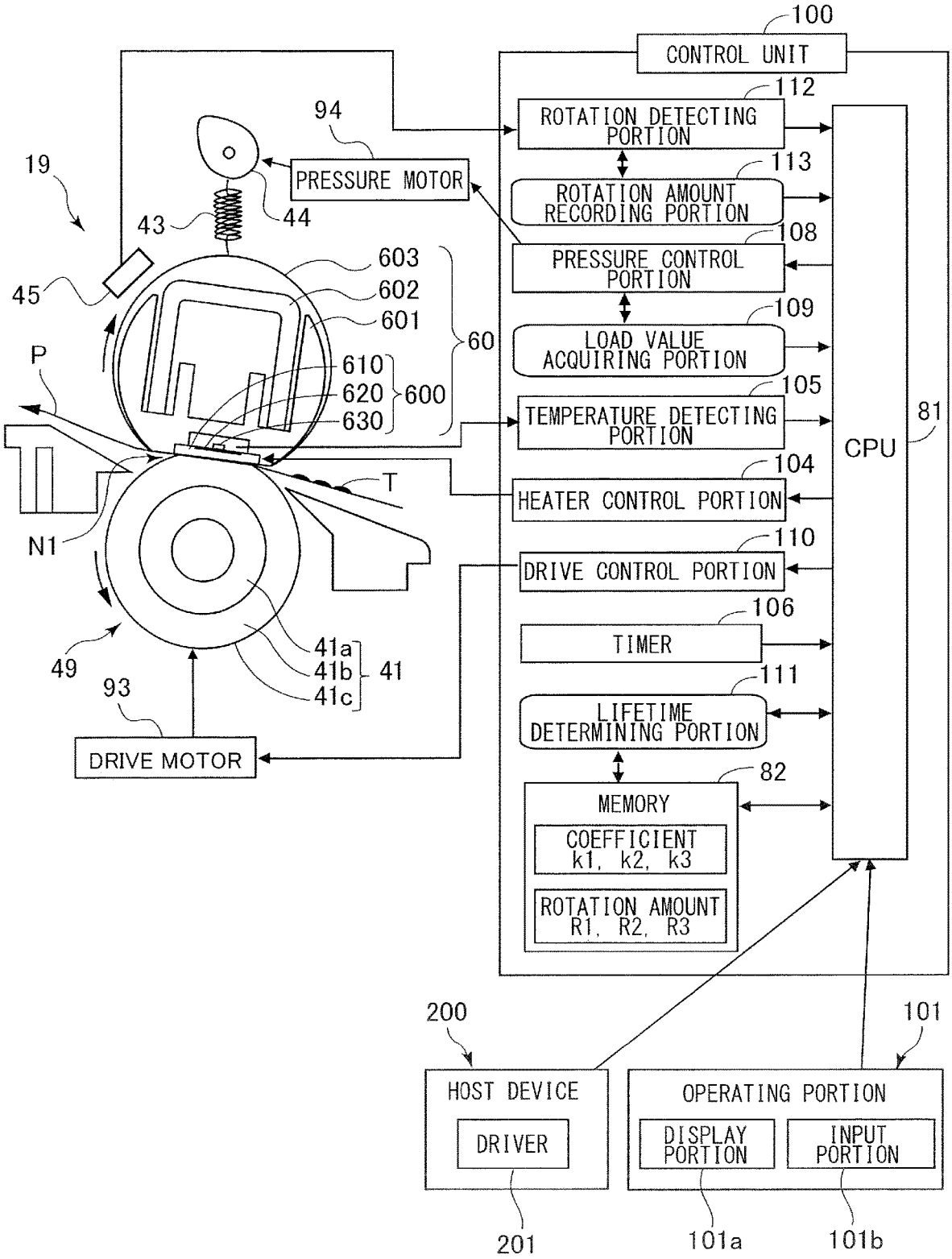
FIG. 6 is a view having combined a schematic drawing of a fixing unit according to a fourth embodiment with a block diagram illustrating a control structure of an image forming apparatus.

FIG. 6 is a view having combined a schematic drawing of a fixing unit 19 according to the present embodiment and a block diagram illustrating a control circuit of the fixing unit 19. The fixing unit 19 is an image heating apparatus in which an image T on the recording material is heated by a heater 600 while nipping and conveying the recording material P by a fixing nip N1 formed between a fixing belt 603 and the pressure roller 41 of a belt unit 60. The recording material P having passed the fixing nip N1 is separated from the fixing belt 603 and discharged from the fixing unit 19.

The belt unit 60 is disposed so that its longitudinal direction is in parallel with a longitudinal direction, i.e., axial direction, of the pressure roller 41. The belt unit 60 includes the heater 600, a heater holder 601, a support stay 602, and a fixing belt 603 which is an endless belt.

The heater 600 serving as a heating element of the present embodiment includes a substrate 610 and a heating element 620 disposed on a circuit on the substrate 610, and the heater 600 is abutted slidably against an inner circumferential surface of the fixing belt 603. The heater 600 is plate-shaped, having a width, that is, length in a conveyance direction of the recording material, of 5 to 20 mm, longitudinal length, that is, length in a width direction of the recording material, of 350 to 400 mm, and a thickness of 0.5 to 2 mm. The shape of the heater 600 is determined by the substrate 610, and according to the present embodiment, the substrate is formed of a plate member formed of alumina having a width of approximately 10 mm, a longitudinal length of approximately 400 mm, and a thickness of approximately 1 mm.

The heating element 620 and a conductor pattern, i.e., wiring, is formed on a rear side of the substrate 610 by thick film printing, i.e., screen printing, using conductive thick film paste. In the present embodiment, silver paste is used for forming the conductor pattern to realize low resistivity, and silver-palladium alloy paste is used for forming the heating element 620 to realize high resistivity. Further, the heating element 620 and the conductor pattern are coated by an insulating coating layer formed of heat-resisting glass, and they are electrically protected from causing leakage and short-circuit.

The heating element 620 is a resistor that generates Joule heat by energization, and it is extended along the longitudinal direction of the substrate 610. The heating element 620 is adjusted to have a width of 1 to 4 mm and a thickness of 5 to 20 μm so that it has a resistance value of a desired value. The heating element 620 according to the present embodiment is set to have a width of approximately 4 mm and a thickness of approximately 10 μm, and a longitudinal length of 297 mm. In a state where the connector provided on the heater 600 is connected to a power supply circuit and voltage is applied to the circuit on the substrate 610 according to which current is flown, the heating element 620 generates heat.

In the present embodiment, the heating element 620 is provided on a rear side of the substrate 610, that is, the side that is not in contact with the fixing belt 603, but the heating element 620 can be provided on a front side of the substrate 610, that is, the side in contact with the fixing belt 603. By providing the heating element 620 on the rear side of the substrate 610, the heat becomes even while being conducted through the substrate 610, so that there is a merit that uniform heat quantity can be to the fixing belt 603 even if a non-heated portion exists in the heating element 620.

A thermistor 630 that serves as a temperature sensor of the present embodiment is installed on the rear side of the heater 600. The thermistor 630 is attached to the substrate 610 in an insulated state with the heating element 620. The temperature detecting portion 105 of the control unit 100 detects temperature of the heater 600 based on the output signal from the thermistor 630. The heater control portion 104 controls ON/OFF of energization to the heating element 620 according to the temperature detected by the temperature detecting portion 105 and based on the temperature setting determined based on property information of the recording material.

Figure 8:
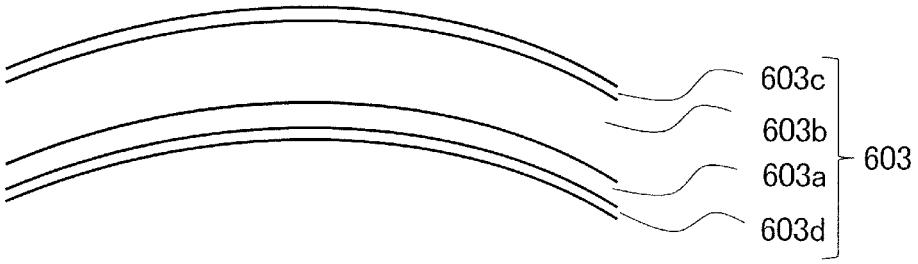
FIG. 8 is a schematic view of a fixing belt according to the fourth embodiment.

As illustrated in the schematic view of FIG. 8, a belt including an elastic layer 603*b* formed on a base layer 603*a*, a release layer 603*c* formed on the elastic layer 603*b* and a friction layer 603*d* formed below the base layer 603*a* on an inner circumference side thereof is used as the fixing belt 603. A metal material such as stainless steel or nickel is used as the constituent material of the base layer 603*a*. Material having elasticity and heat resistance such as silicon rubber and fluororubber can be used as the elastic layer 603*b*. Fluororesin and silicone resin can be used as the release layer 603*c*. Resin having high durability and high heat resistance such as polyimide resin, polyamide-imide resin and polyether ether ketone resin is suitable for the friction layer 603*d*.

The fixing belt 603 according to the present embodiment utilizes a cylindrical nickel member having an outer diameter of approximately 30 mm, a longitudinal, i.e., depth direction of FIG. 6, length of approximately 330 mm and a thickness of approximately 30 μm as the base layer 603*a*. The elastic layer 603*b* formed of silicone rubber with a thickness of 400 μm is formed on the base layer 603*a*, and further, a fluororesin tube having a thickness of approximately 20 μm is coated as the release layer 603*c* on the elastic layer 603*b*. A polyamide-imide resin having a thickness of 10 μm is used as the friction layer 603*d*.

The rotation of the fixing belt 603 is detected using a photoreflector 45. A marking for measurement having a higher reflectivity compared to the surrounding is provided on the surface of the fixing belt 603. A rotation detecting portion 112 of the control unit 100 detects the rotation of the fixing belt 603 by detecting the change of output signal of the photoreflector 45 when the marking passes.

As illustrated in FIG. 6, the pressure roller 41 is composed of the core shaft 41*a*, the elastic layer 41*b* formed of silicone rubber, and the release layer, i.e., surface layer, 41*c* formed of fluorine-based resin. The pressure roller 41 is a nip forming member that is abutted against an outer side of the fixing belt 603 and forms the fixing nip N1 by cooperating with the fixing belt 603.

The heater 600 is fixed to a lower side of the heater holder 601. The heater holder 601 is a retaining member that retains the heater 600 in a state pressed toward an inner side of the fixing belt 603. The heater holder 601 includes an outer circumference portion that is arc-shaped in a cross-section viewed in the longitudinal direction, and functions as a guide for regulating the rotation track of the fixing belt 603. Resin having heat resistance and the like is used as the heater holder 601. In the present embodiment, Zenite 7755 (trademark) produced by Du Pont Co. was used.

In order to reduce friction between the fixing belt 603 and the heater 600 or the heater holder 601 and to rotate the fixing belt 603 smoothly, a lubricant is applied between the inner circumferential surface of the fixing belt 603 and the heater 600. Oil and grease having heat resistance is preferably used as the lubricant, and materials such as silicone oil, PFPE (perfluoro-polyether) and fluorine grease are used. Fluorine grease MOLYKOTE (Registered Trademark) HP-300 produced by Dow Corning Toray Co., Ltd. was used as lubricant in the present embodiment.

The heater holder 601 is supported on the support stay 602. The support stay 602 is preferably formed of a material that is not easily deflected even if high pressure is applied, and in the present embodiment, SUS 304 which is a stainless steel material was used.

Figure 7:
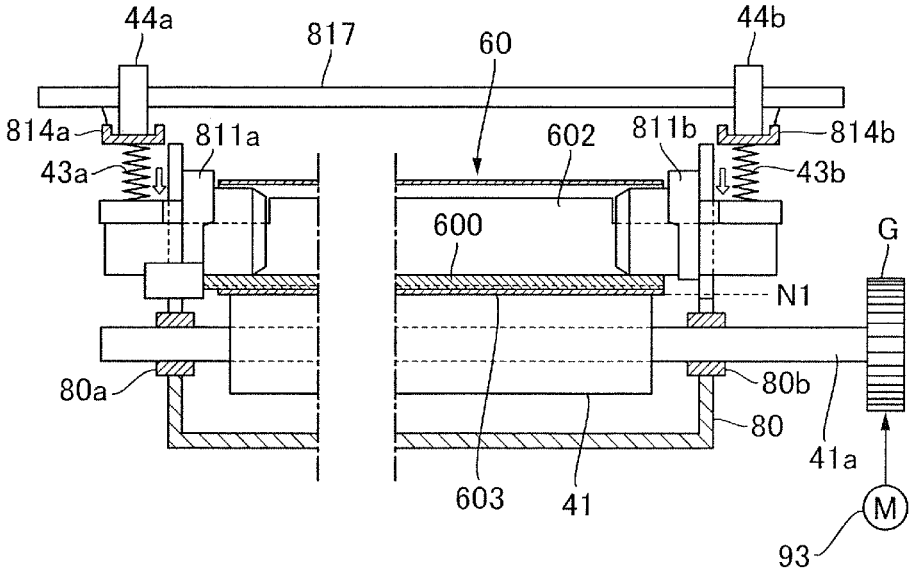
FIG. 7 is a cross-sectional view in which the fixing unit according to the fourth embodiment is cut at a plane along a longitudinal direction.

As illustrated in FIG. 7, the support stay 602 is supported at both end portions in the longitudinal direction by left and right flanges 811*a* and 811*b*. The flanges 811*a* and 811*b* regulate movement of the fixing belt 603 in the longitudinal direction and regulate circumferential shape of the fixing belt 603. Resin having heat resistance is used as the flanges 811*a* and 811*b*. In the present embodiment, PPS (polyphenylene sulfide) was used.

A pressurizing configuration of the belt unit 60 and the pressure roller 41 will be described. The fixing unit 19 includes the pressure cam 44 connected to the belt unit 60 via a spring 43 (refer to FIG. 6). The pressure cam 44 is a separating mechanism according to the present embodiment that enables to switch between a state where the belt unit 60 and the pressure roller 41 are mutually abutted and a state where the belt unit 60 and the pressure roller 41 are separated.

As illustrated in FIG. 7, pressure cams 44*a* and 44*b* and pressure springs 43*a* and 43*b* are provided on both sides in the longitudinal direction. The pressure springs 43*a* and 43*b* are arranged between the flanges 811*a* and 811*b* of the belt unit 60 and arms 814*a* and 814*b* abutted against the pressure cams 44*a* and 44*b*. In a state where a cam shaft 817 that supports the pressure cams 44*a* and 44*b* is rotated by the pressure motor 94 (FIG. 6), the arms 814*a* and 814*b* swing, and the flanges 811*a* and 811*b* are urged via the pressure springs 43*a* and 43*b*. Thereby, the belt unit 60 is abutted against or separated from the pressure roller 41, or the pressurizing force in the abutted state is changed.

Further, the core shaft 41*a* of the pressure roller 41 is supported rotatably via bearings 80*a* and 80*b* by a side plate 80 of the fixing unit 19. Further, a gear G that is drive-coupled to the drive motor 93 is provided at one end of the core shaft 41*a*. The pressure roller 41 rotates by driving force from the drive motor 93, and the fixing belt 603 is driven to rotate by the pressure roller 41. The drive control portion 110 (FIG. 6) of the control unit 100 controls rotation of the pressure roller 41 by controlling energization to the drive motor 93 as the power source. The rotational speed of the pressure roller 41 is adjusted such that the conveyance speed of the recording material at the fixing nip N1 is at a predetermined process speed, such as approximately 250 mm/sec.

Abrasion of Fixing Belt

Now, abrasion of the fixing belt 603 will be described. The fixing belt 603 according to the present embodiment includes the friction layer 603*d* having a small sliding friction disposed on the inner circumferential surface, but if the belt is used for a long period of time, scraping of the friction layer 603*d* occurs by sliding friction with the heater 600 or the heater holder 601, and the film thickness of the friction layer 603*d* is reduced.

Figure 9:
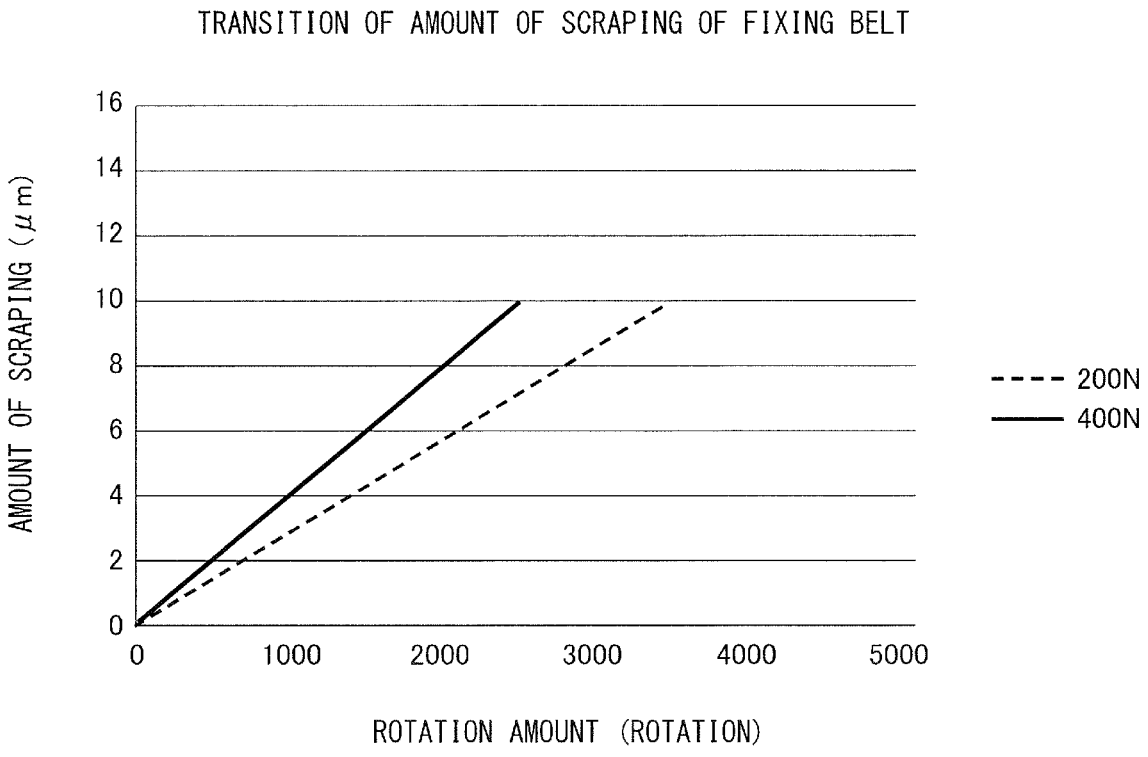
FIG. 9 is a graph illustrating a transition of amount of scraping with respect to a rotation amount of the fixing belt according to the fourth embodiment.

FIG. 9 is a graph illustrating a transition of amount of scraping, i.e., amount of reduction of film thickness, of the friction layer 603*d* with respect to the rotation amount of the fixing belt 603 for each setting of pressurizing force. Solid line corresponds to a case where the pressurizing force is 400 N, and dotted line corresponds to a case where the pressurizing force is 200 N. It can be recognized that as the pressurizing force increases, abrasion of the friction layer 603*d* is advanced faster. This is considered to be cause by the friction acting on the sliding surface between the fixing belt 603 and the heater 600 or the heater holder 601 being increased as the pressurizing force increases. Further, since the change of film thickness of the friction layer 603*d* is very small and therefore not illustrated, in the case where the pressurizing force is 0 N, that is, if the fixing belt 603 is separated from the pressure roller 41, abrasion of the friction layer 603*d* becomes even more gentle than the case where the pressurizing force is 200 N.

The amount of scraping of the friction layer 603*d* was calculated by performing a sheet feed test in a state where the pressurizing force is set to the above-described predetermined value and measuring the rotation amount of the fixing belt 603, to thereby measure the film thickness of the friction layer 603*d* every predetermined rotation amount. The film thickness was measured using white interferometer VertScan MM 5000 (product of Mitsubishi Chemical Systems).

In the fixing unit 19 according to the present embodiment, in a state where the pressurizing force is 200 N, the film thickness of the friction layer 603*d* became 0 μm after approximately 3.5 million rotations, which corresponds to approximately 300,000 sheets of A4 paper. In a state where the friction layer 603*d* is scraped and gone, the layers of the belt having greater sliding friction than the friction layer 603*d* contact the heater 600 or the heater holder 601, and driving torque of the fixing belt 603 is increased extremely. Thereby, rotation of the fixing belt 603 is hindered, such as by the fixing belt 603 serving as a driven rotary member slipping against the pressure roller 41 serving as a drive rotary member. If the heater 600 performs heating in a state where the fixing belt 603 is stopped, a part of the belt becomes extremely heated and may be damaged. Therefore, the degree of abrasion of the friction layer 603*d* is one of the main causes that determine the lifetime of the fixing unit 19.

Determination of Lifetime

In the present embodiment, the rotation amount of the fixing belt 603 is measured per setting of the pressurizing force in the fixing nip N1, the LIFE value of the fixing belt 603 is calculated based on the measured rotation amount, and determination of lifetime of the fixing unit 19 is performed. As illustrated in the following Table 4, in the present embodiment, the pressurizing state of the fixing nip N1 is divided into three divisions, where the pressurizing force is 400 N, 200 N and 0 N. The state where the pressurizing force is 0 N corresponds to a state where the fixing belt 603 is separated from the pressure roller 41.

TABLE 4

| PRESSURIZING FORCE[N] | ROTATION AMOUNT | COEFFICIENT |
|---|---|---|
| 400 | R1 | k1 |
| 200 | R2 | k2 |
| 0 | R3 | k3 |

A rotation amount recording portion 113 illustrated in FIG. 6 records a rotation amount Ri (i=1, 2, 3) of the fixing belt 603 to a predetermined area of the memory 82 based on the detection result of the rotation detecting portion 112. In this state, the rotation amount recording portion 113 updates any one of the rotation amount Ri corresponding to the current pressurizing state based on the setting of the pressurizing force acquired by the load value acquiring portion 109. The rotation amount recording portion 113 serves as a rotation amount recording portion according to the present embodiment. Further, the value of coefficient ki is determined in advance based on the measurement result illustrated in FIG. 9 and stored in the memory 82. A rotation amount R1 serves as a first rotation amount of the present embodiment, which is a cumulative rotation amount during which the pair of rotary members is rotated in an abutted state. A rotation amount R3 serves as a second rotation amount of the present embodiment, which is a cumulative rotation amount during which the pair of rotary members is rotated in a separated state. Coefficients k1 and k2 are examples of data illustrating the relationship between the rotation amount of the pair of rotary members and decreasing degree of lifetime of the pair of rotary members. Among these coefficients, the coefficient k1 serves as a fourth coefficient of the present embodiment representing a rate of decrease in lifetime of the pair of rotary members per unit length of the first rotation amount (R1), and the coefficient k3 serves as a fifth coefficient of the present embodiment representing a rate of decrease in lifetime of the pair of rotary members per unit length of the second rotation amount (R3).

In the present embodiment, the expression for calculating the LIFE value representing the degree of abrasion of the fixing belt 603 according to the present embodiment is as follows. Constant "A" is a normalization constant set in advance together with the coefficients k1, k2 and k3. The magnitude correlation of k1, k2 and k3 is k1>k2>k3.

$$\mathrm{LIFE} = \left[\sum_{i=1}^{3} \frac{Ri \times ki}{A}\right] \times 100 \tag{4}$$

The control unit 100 serving as an executing portion in the present embodiment determines lifetime of the fixing unit 19 by a similar processing as the first embodiment, except for updating one of the rotation amounts R1 to R3 according to the current pressurizing state and calculating the LIFE value using the coefficients k1 to k3 and the rotation amounts R1 to R3. That is, the rotation amount recording portion 113 updates one of the rotation amounts R1, R2 and R3 corresponding to the pressurizing force acquired by the load value acquiring portion 109 while the fixing belt 603 is rotated. The lifetime determining portion 111 calculates the LIFE value according to Expression (4) using the coefficients k1 to k3 stored in advance in the memory 82 and the rotation amounts R1 to R3 recorded by the rotation amount recording portion 113 (refer to S104 and S105 of FIG. 5). Then, in a case where the LIFE value is 100% or greater, lifetime notice of the fixing unit 19 is executed as the notification process (S106, S107).

According to this configuration, even in a state where abrasion speed of the friction layer 603*d* with respect to the rotation amount of the fixing belt 603 is not fixed according to the difference in the pressurizing state, lifetime notice is performed at a more appropriate timing. That is, according to the present embodiment, the degradation level, i.e., LIFE value, of the fixing belt 603 is calculated using the rotation amount recorded for each pressurizing state and the coefficient set for each pressurizing state, and lifetime of the fixing belt 603 is determined based on the calculated result. Therefore, the LIFE value will more appropriately reflect the difference in abrasion speed due to the difference in the pressurizing state, and the predictability of replacement timing is improved.

Further, the execution timing of the notification process is determined so that the cumulative value of the rotation amount until the notification process is executed is set higher as the ratio of the rotation amount (R3) during the period in which the fixing belt is separated occupies a greater ratio in the cumulative value (R1+R2+R3) of the rotation amount. As a result, lifetime notice is executed at a timing when abrasion of the fixing belt 603 has advanced and the necessity of replacement has actually increased.

Modified Example

In the present embodiment, an example has been described of a case where one of the pair of rotary members for nipping the recording material at the fixing unit 19 is a belt member, but the present invention is also applicable to a configuration where both the pair of rotary members are belt members. Further, the present invention is applicable to a configuration similar to first to third embodiments in which the recording material is nipped by a pair of rollers, as long as the abrasion of the surface layer influences the lifetime of the fixing unit 19.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-142975, filed on Jul. 30, 2018, which is hereby incorporated by reference herein in its entirety.

What is claimed is:

1. An image forming apparatus comprising:

an image forming unit configured to form a toner image on a recording material;

a pair of rotary members configured to nip and convey the recording material on which the toner image has been formed by the image forming unit;

a heating element configured to heat the toner image on the recording material via the pair of rotary members;

a separating mechanism configured to separate the pair of rotary members;

a heating time recording portion configured to record a first heating time and a second heating time, the first heating time being a cumulative length of a period during which the pair of rotary members in an abutted state is heated by the heating element, the second heating time being a cumulative length of the period during which the pair of rotary members in a separated state is heated by the heating element;

a storage unit configured to store data indicating a relationship between length of the period during which the pair of rotary members is heated and decrease in lifetime of the pair of rotary members, the data being set such that a degree of decrease in lifetime of the pair of rotary members with respect to the first heating time is greater than a degree of decrease in lifetime of the pair of rotary members with respect to the second heating time; and a determining portion configured to determine a remaining lifetime of the pair of rotary members using the first heating time and the second heating time recorded by the heating time recording portion and the data stored in the storage unit.

2. The image forming apparatus according to claim 1, wherein the data stored in the storage unit includes a first coefficient representing a rate of decrease in lifetime of the pair of rotary members per unit length of the first heating time, and a second coefficient representing a rate of decrease in lifetime of the pair of rotary members per unit length of the second heating time, wherein the determining portion is configured to determine the remaining lifetime of the pair of rotary members based on a sum of a product of the first heating time and the first coefficient and a product of the second heating time and the second coefficient, and wherein the first coefficient is greater than the second coefficient.

3. The image forming apparatus according to claim 2, wherein the separating mechanism is configured to change a state of the pair of rotary members between a state being abutted with a first pressurizing force and a state being abutted with a second pressurizing force that is smaller than the first pressurizing force, wherein the first heating time is the cumulative length of the period during which the pair of rotary members is heated by the heating element in a state where the pair of rotary members is abutted with the first pressurizing force, wherein the heating time recording portion is configured to record a third heating time that is a cumulative length of the period during which the pair of rotary members is heated by the heating element in a state where the pair of rotary members is abutted with the second pressurizing force, and wherein the data stored in the storage unit includes a third coefficient representing a rate of decrease in the remaining lifetime of the pair of rotary members per unit length of the third heating time, and wherein the third coefficient is smaller than the first coefficient and greater than the second coefficient.

4. The image forming apparatus according to claim 1, further comprising a temperature control unit configured to control the heating element to regulate a temperature of the pair of rotary members to either one of a plurality of target temperatures in a state where the pair of rotary members is abutted, and wherein the data stored in the storage unit includes a plurality of coefficients each representing a rate of decrease in lifetime of the pair of rotary members with respect to the period during which the pair of rotary members is heated by the heating element in a state where the pair of rotary members is abutted, values of the plurality of coefficients being different per target temperature of the pair of rotary members.

5. The image forming apparatus according to claim 1, further comprising a notification unit configured to notify information related to replacement of the pair of rotary members based on a result of determination of the determining portion.

6. The image forming apparatus according to claim 1, wherein the pair of rotary members comprises a roller comprising an elastic layer formed of a rubber material and a release layer formed of a resin material that covers an outer circumference of the elastic layer.

7. An image forming apparatus comprising:

an image forming unit configured to form a toner image on a recording material;

a pair of rotary members configured to nip and convey the recording material on which the toner image has been formed by the image forming unit;

a heating element configured to heat the toner image on the recording material via the pair of rotary members;

a separating mechanism configured to separate the pair of rotary members; and an executing portion configured to execute a notification process to notify information related to replacement of the pair of rotary members, wherein the executing portion executes the notification process such that as a ratio of a period during which the pair of rotary members is heated in a separated state by the heating element with respect to a total period during which the pair of rotary members is heated either in the separated state or in an abutted state by the heating element becomes greater, a cumulative length of a period during which the pair of rotary members is heated by the heating element since the pair of rotary members has been replaced until the notification process is executed becomes longer.

8. The image forming apparatus according to claim 7, wherein the pair of rotary members comprises a roller comprising an elastic layer formed of a rubber material and a release layer formed of a resin material that covers an outer circumference of the elastic layer.

9. An image forming apparatus comprising:

an image forming unit configured to form a toner image on a recording material;

a pair of rotary members configured to nip and convey the recording material on which the toner image has been formed by the image forming unit;

a heating element configured to heat the toner image on the recording material via the pair of rotary members;

a separating mechanism configured to separate the pair of rotary members;

a rotation amount recording portion configured to record a first rotation amount and a second rotation amount, the first rotation amount being a cumulative rotation amount during which the pair of rotary members is rotated in an abutted state, the second rotation amount being a cumulative rotation amount during which the pair of rotary members is rotated in a separated state;

a storage unit configured to store data indicating a relationship between rotation amount of the pair of rotary members and decrease in lifetime of the pair of rotary members, the data being set such that a degree of decrease in lifetime of the pair of rotary members with respect to the first rotation amount is greater than a degree of decrease in lifetime of the pair of rotary members with respect to the second rotation amount; and a determining portion configured to determine a remaining lifetime of the pair of rotary members using the first rotation amount and the second rotation amount recorded by the rotation amount recording portion and the data stored in the storage unit.

10. The image forming apparatus according to claim 9, wherein the data stored in the storage unit includes a fourth coefficient representing a rate of decrease in lifetime of the pair of rotary members per unit length of the first rotation amount, and a fifth coefficient representing a rate of decrease in lifetime of the pair of rotary members per unit length of the second rotation amount, wherein the determining portion is configured to determine the remaining lifetime of the pair of rotary member based on a sum of a product of the first rotation amount and the fourth coefficient and a product of the second rotation amount and the fifth coefficient, and wherein the fourth coefficient is greater than the fifth coefficient.

11. The image forming apparatus according to claim 9, wherein the pair of rotary members is an endless belt including a belt comprising a base layer formed of a metal material and a friction layer formed of a resin material disposed on an inner circumference side of the base layer, and wherein the image forming apparatus further comprises a guide arranged in contact with the friction layer to regulate a rotation track of the belt.

12. An image forming apparatus comprising:

an image forming unit configured to form a toner image on a recording material;

a pair of rotary members configured to nip and convey the recording material on which the toner image has been formed by the image forming unit;

a heating element configured to heat the toner image on the recording material via the pair of rotary members;

a separating mechanism configured to separate the pair of rotary members; and an executing portion configured to execute a notification process to notify information related to replacement of the pair of rotary members, wherein the executing portion executes the notification process such that as a ratio of a rotation amount during which the pair of rotary members is rotated in a separated state with respect to a total rotation amount during which the pair of rotary members is rotated either in an abutted state or in the separated state becomes greater, a cumulative value of the rotation amount during which the pair of rotary members is rotated since the pair of rotary members has been replaced until the notification process is executed becomes longer.

13. The image forming apparatus according to claim 12, wherein the pair of rotary members is an endless belt including a belt comprising a base layer formed of a metal material and a friction layer formed of a resin material disposed on an inner circumference side of the base layer, and wherein the image forming apparatus further comprises a guide arranged in contact with the friction layer to regulate a rotation track of the belt.

* * * * *